United States Patent [19]

Neenan

[11] 4,320,541

[45] Mar. 23, 1982

[54] METHOD AND APPARATUS FOR PROVIDING A PULSATING AIR/WATER JET

[76] Inventor: John S. Neenan, 4100 Mapeltree Dr., Anaheim, Calif. 92807

[21] Appl. No.: 93,754

[22] Filed: Nov. 13, 1979

[51] Int. Cl.[3] ..... A61H 9/00; A47K 3/00; B05B 1/08

[52] U.S. Cl. ..... 4/492; 4/542; 4/569; 128/66; 137/888; 137/892; 239/383; 239/428.5; 239/432; 261/DIG. 75

[58] Field of Search ..... 4/488, 492, 496, 507, 4/541-544, 567-569, 570; 137/888, 892, 893; 261/DIG. 75; 128/66, 370; 239/428.5, 403, 432, 101, 102, 381, 383, 222.17, 222.21, 416

[56] References Cited

U.S. PATENT DOCUMENTS

| | | | |
|---|---|---|---|
| 475,452 | 5/1892 | Keen | 239/222.21 |
| 1,446,887 | 2/1923 | Donovan . | |
| 1,826,208 | 10/1931 | Gibson | 239/222.21 X |
| 2,260,301 | 10/1941 | Cushman | 239/222.21 X |
| 2,878,066 | 3/1959 | Erwin . | |
| 3,424,250 | 1/1969 | Thomae | 239/428.5 |
| 3,471,091 | 10/1969 | Baker . | |
| 3,473,736 | 10/1969 | Heitzman . | |
| 3,568,716 | 3/1971 | Heitzman . | |
| 3,601,316 | 8/1971 | Murray | 239/222.17 |
| 3,628,529 | 12/1971 | Steimle . | |
| 3,664,585 | 5/1972 | Curtis | 239/381 X |
| 3,713,587 | 1/1973 | Carson . | |
| 3,777,746 | 12/1973 | Kwok . | |
| 3,890,655 | 6/1975 | Mathis . | |
| 3,890,656 | 6/1975 | Mathis . | |
| 3,905,358 | 9/1975 | Jacuzzi . | |
| 3,946,449 | 3/1976 | Mathis | 128/66 X |
| 4,101,075 | 7/1978 | Heitzman . | |
| 4,204,495 | 5/1980 | Wyner | 239/383 X |

*Primary Examiner*—Stuart S. Levy

*Attorney, Agent, or Firm*—Gausewitz, Carr, Rothenberg & Edwards

[57] ABSTRACT

A venturi type mixer that produces an aerated water jet for spas, therapy pools, swimming pools and the like, is provided with a pulsating action by means of a flow impeding spoiler that momentarily and repetitively disturbs the water jet that is projected into the mixing chamber. Disturbance of the jet effectively disables the vacuum produced by the venturi action to thereby cause discharge of a water stream of decreased velocity having considerably less entrained air. The spoiler is moved into and out of the water jet by means of an automatically reciprocating piston that is operated by a combination of a spring and the vacuum produced by the venturi action. Alternatively the spoiler may be rotated into and out of the path of the jet by a water driven rotor, or the jet orifice may be rotated relative to a fixed spoiler.

36 Claims, 19 Drawing Figures

FIG. 5.
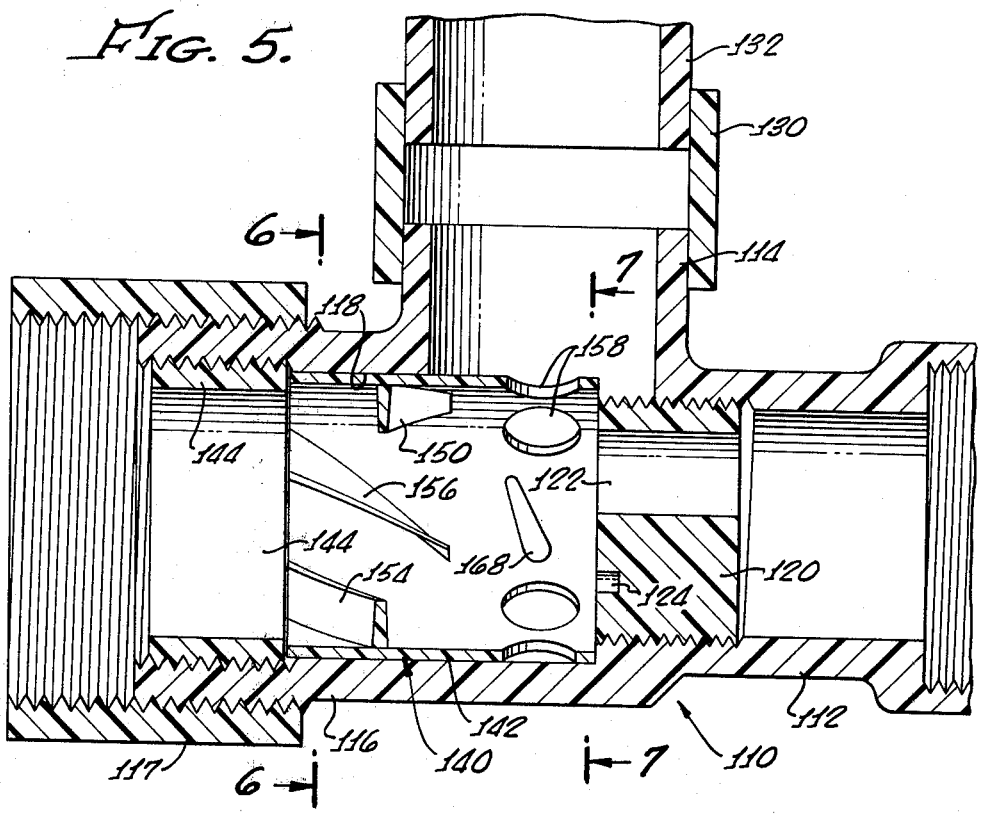
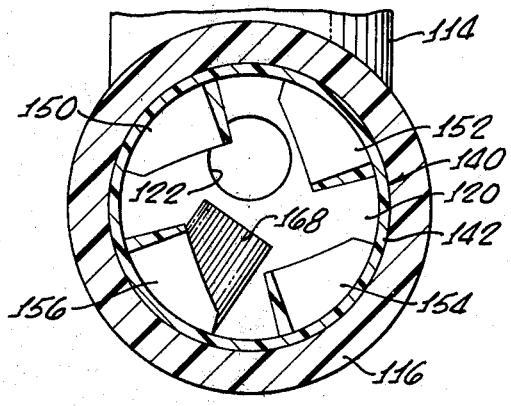
FIG. 6.
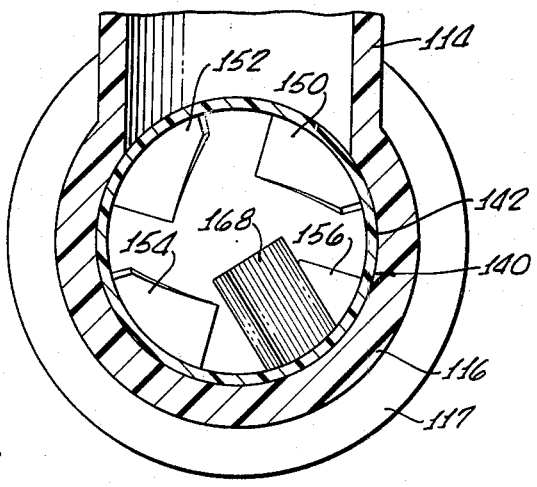
FIG. 7.

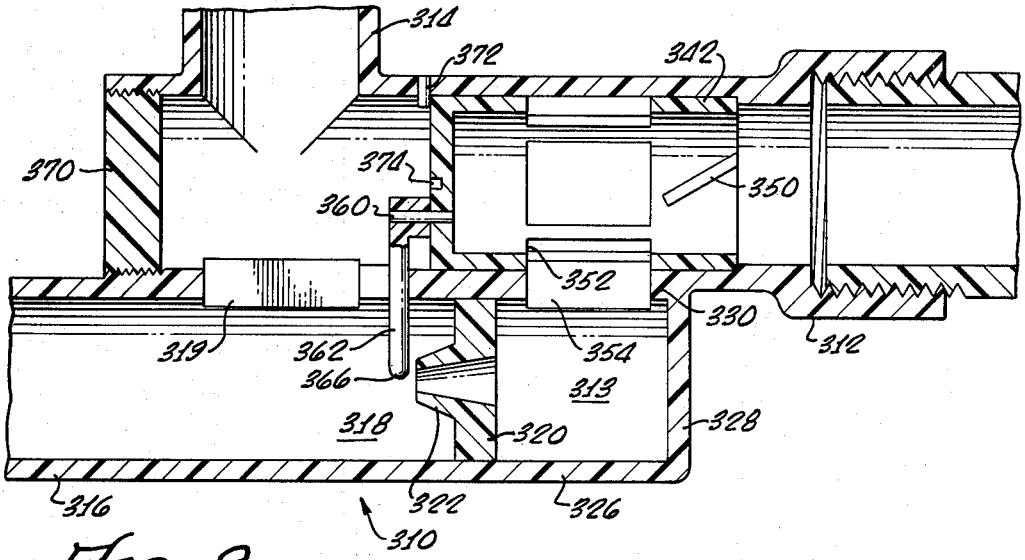
FIG. 9.
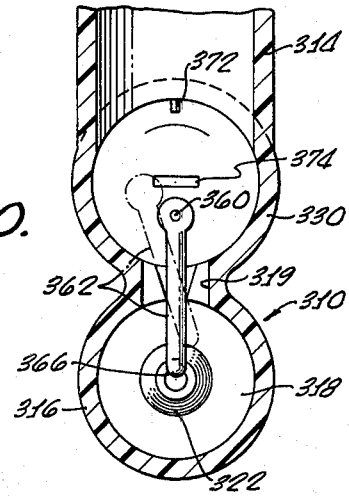
FIG. 10.
FIG. 8.
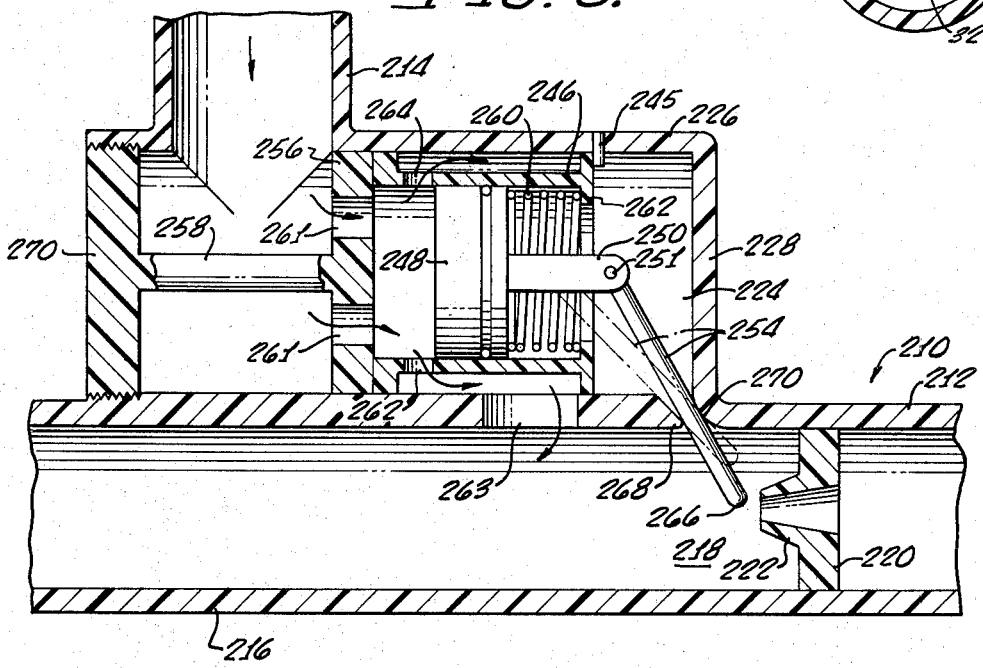

FIG. 13.
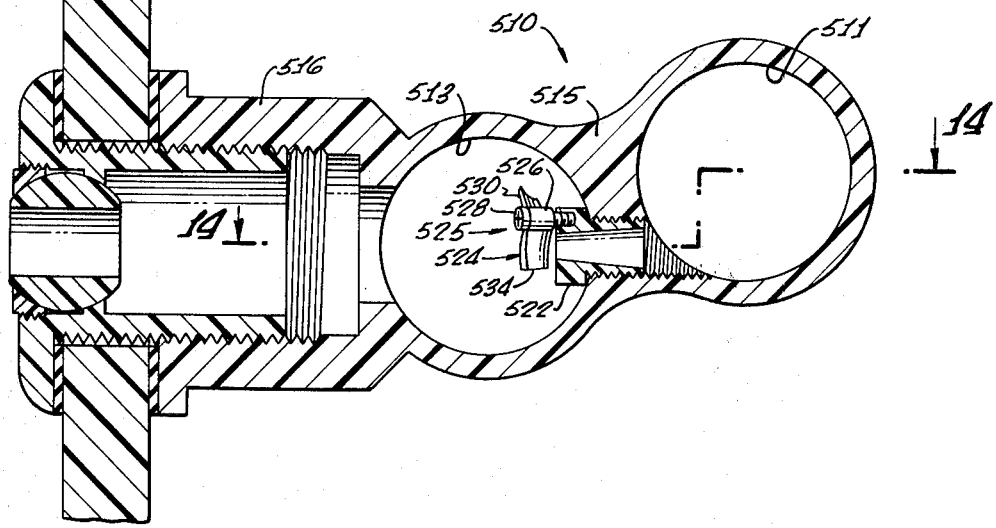
FIG. 14.
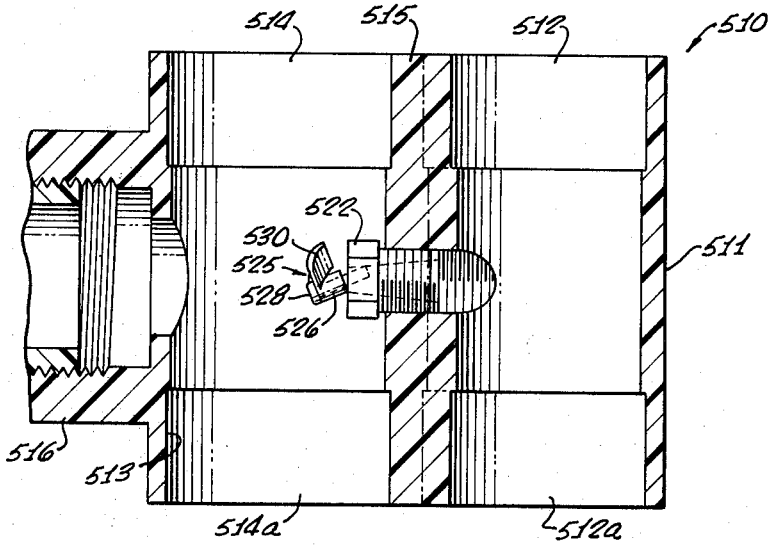
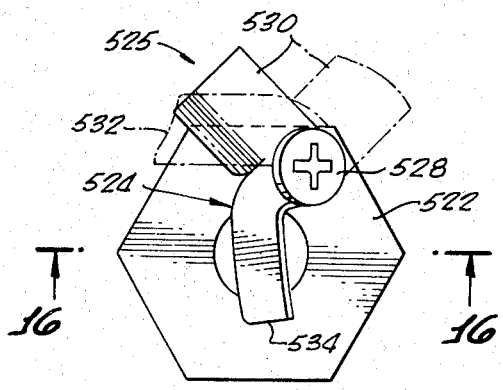
FIG. 15.
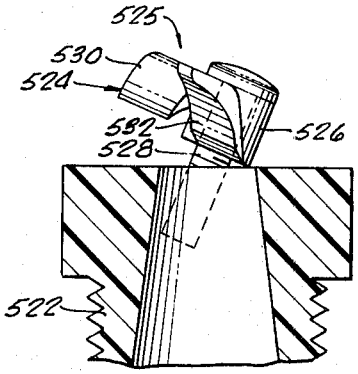
FIG. 16.

METHOD AND APPARATUS FOR PROVIDING A PULSATING AIR/WATER JET

BACKGROUND OF THE INVENTION

The present invention relates to venturi type mixing of gas and liquids, and more particularly concerns such type of mixing that produces a pulsating discharge of the mixture.

In spas, therapy pools, swimming pools and similar apparatus, jets of water are projected into the body of water contained in the spa, pool or tub to provide a type of hydromassage, enhanced relaxation and other therapeutic benefits. To increase the action, force and benefit of such jets, the water, before projection, is mixed with air by means of air/water mixers that commonly employ a venturi type action. An increased velocity jet projected into a mixing chamber provides an area of reduced pressure that pulls air into the chamber through a passage that communicates with ambient atmosphere. The air pulled into the chamber mixes with the water and the mixture is discharged through a nozzle into (below the surface of) the body of water contained in the spa or pool tub. Venturi type mixers for spas, therapy pools and the like are typified by those shown in the U.S. Pat. Nos. to Baker 3,471,091; Steimle 3,628,529; Jacuzzi 3,905,358; Mathis 3,890,655; and Mathis 3,890,656. Another type of such a venturi type jet is shown in the co-pending application of Gerald Moreland, Ser. No. 040,589, filed May 21, 1979, now U.S. Pat. No. 4,264,039, entitled AERATOR.

The enhanced massaging and therapeutic actions of pulsating nonaerated water jets are well known and typical devices for providing such water pulsations (without air entrainment) are shown in the U.S. Pat. Nos. to Erwin 2,878,066; Donovan 1,446,887; Heitzman 3,473,736, and Heitzman 4,101,075. Pulsed water jets of the prior art have either repetitively diverted the water flow from the desired outlet or repetitively stopped water flow into the water outlet. Prior efforts to provide a pulsed air/water mixer have merely followed principles used in pulsation of nonaerated water streams and employed devices to either stop or divert the water flow before it enters the mixing chamber.

Devices that totally obstruct the water flow can cause abrupt pressure increases and noise, imposing severe strains upon the system. Devices attempting to control air flow have generally required external controlling mechanisms and thus become less efficient, more complex, and more costly.

Accordingly, it is an object of the present invention to provide a pulsed air/water mixer that avoids or eliminates above-mentioned problems and limitations of prior devices.

SUMMARY OF THE INVENTION

In carrying out principles of the invention in accordance with a preferred embodiment thereof, a venturi type action is employed to mix gas with a liquid stream of increased velocity and to thereby reduce pressure in a mixing chamber. At a point within the chamber the liquid stream is intermittently obstructed thereby intermittently interrupting the venturi action. This may be achieved by repetitively changing the position of a spoiler member relative to the liquid jet so that at least a part of the path of the liquid jet within the chamber is momentarily interrupted. This action both diminishes the force of the water jet and greatly diminishes its aeration. The lack of aeration of the jet further attenuates its force.

Apparatus for carrying out the method includes a mixer body that defines a mixing chamber having an air input port and mixture outlet, a jet nozzle in the body positioned to project an increased velocity stream of water along a path in the chamber, and means for repetitively positioning a flow-disturbing member in the water stream path within the chamber. This is achieved by cyclically shifting the water stream path relative to a fixed disturbing member in the chamber, or by cyclically shifting a movable member into and out of a fixed water stream path.

BRIEF DESCRIPTION OF THE DRAWINGS

FIG. 5 is a longitudinal cross section of the mixer of FIG. 4;

FIGS. 6 and 7 are cross sections of the mixer of FIG. 4;

FIG. 8 shows a longitudinal section of another embodiment of the device having a reciprocating piston mechanism that is accessible from the discharge end of the device;

FIG. 9 is a longitudinal sectional view of still another embodiment of a pulsating air/water mixer;

FIG. 10 is a sectional view of the mixer of FIG. 9;

FIG. 13 is a cross section taken in a vertical plane of a further embodiment, having a rotatable spoiler mounted directly to the jet nozzle;

FIG. 14 is a cross section taken on lines 14—14 of the modification of FIG. 13;

FIG. 15 is a head-on view of the rotating spoiler and nozzle of FIGS. 13 and 14;

FIG. 16 is a section taken on lines 16—16 of FIG. 15;

DETAILED DESCRIPTION

Figure 1:
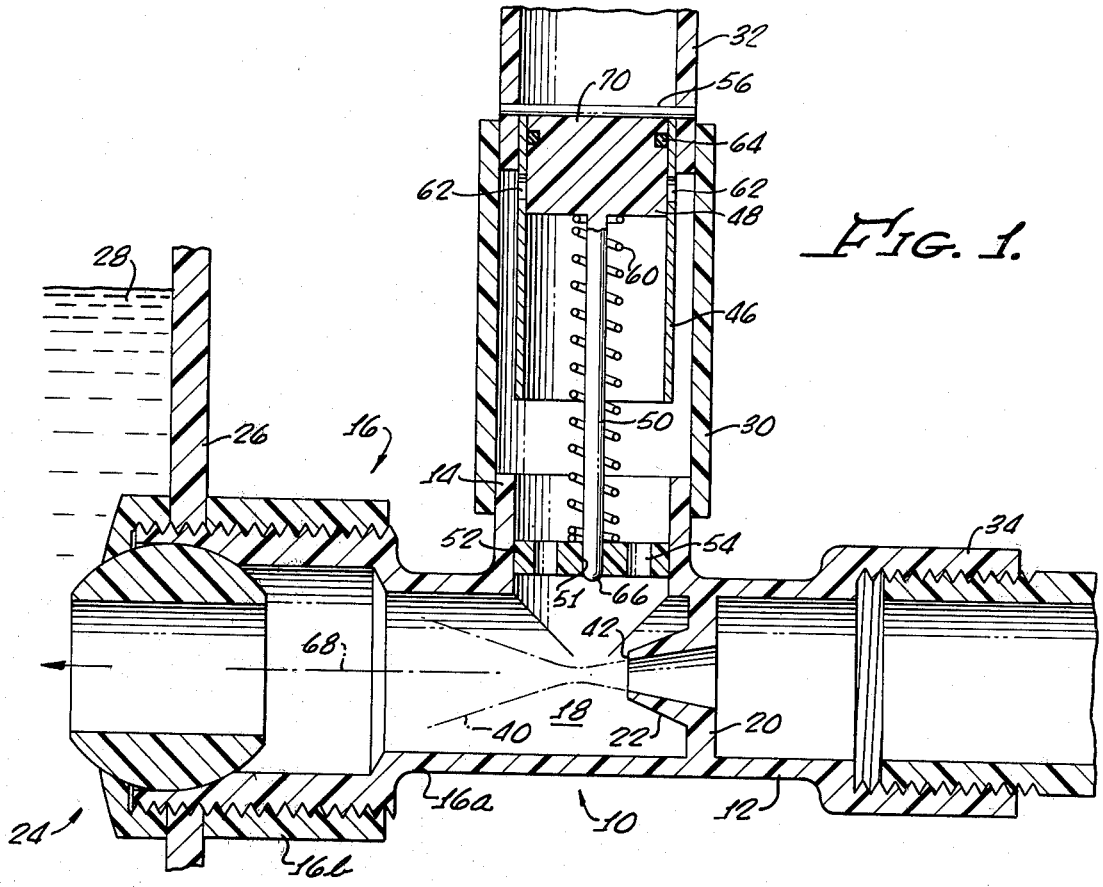
FIG. 1 is a sectional view of a pulsating air/water mixer embodying principles of the present invention.
Figure 2:
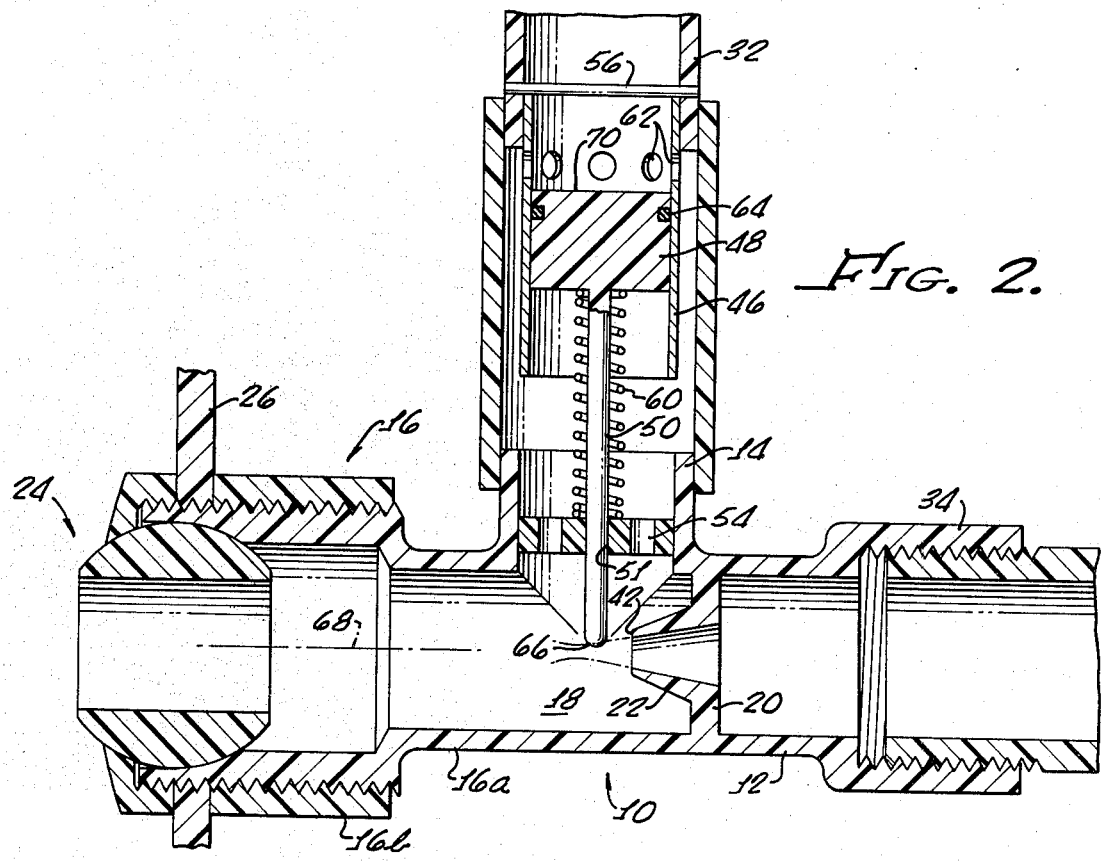
FIG. 2 is a view similar to that of FIG. 1, showing the device in flow-disturbing position.
Figure 3:
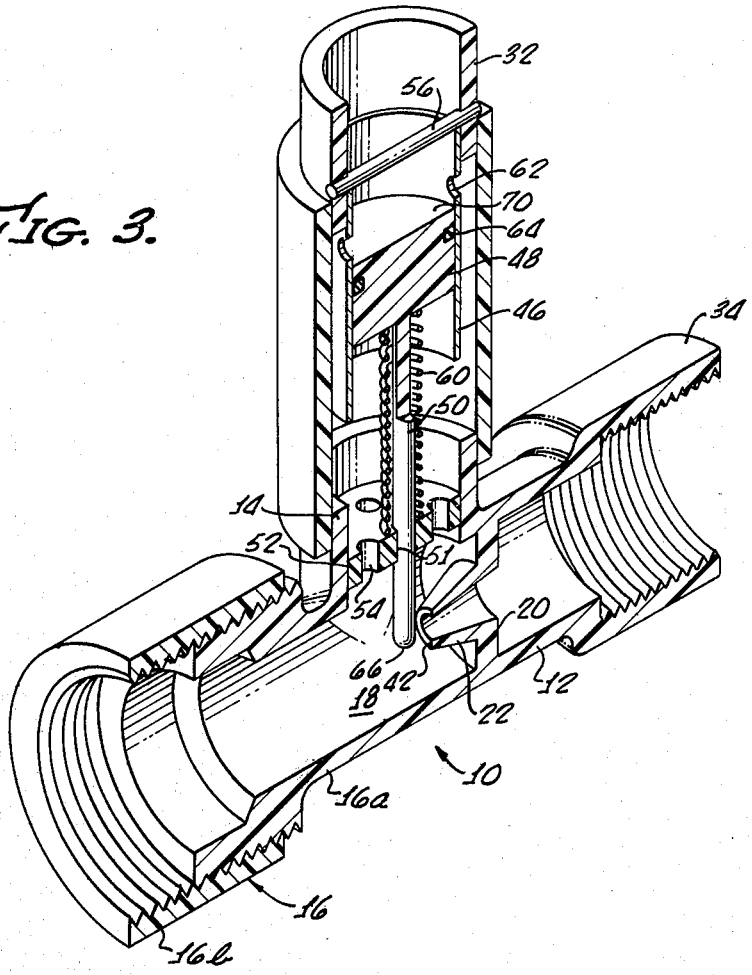
FIG. 3 is a pictorial view, with parts cut away, of the device of FIGS. 1 and 2.

As shown in FIGS. 1, 2, and 3, a venturi type air/water mixer has a mixer body 10 formed with a water inlet passage or port 12, an air inlet passage or port 14, and a mixture discharge port or passage 16. A mixing chamber 18 is defined within the mixer body in communication with ports 14, 16 and is separated from water inlet port 12 by a partition 20 having a restricted orifice in the form of a tapering water jet nozzle 22 that projects slightly into the chamber. Outlet port 16 is connected to a discharge fitting 24 that is secured to and extends through the wall 26 of a spa, therapy tub, swimming pool or the like (only a portion of which is shown), below the surface 28 of water contained in the tub. Air inlet 14 is connected by means of a fitting 30 and a conduit 32 to a source of air which is preferably ambient atmosphere, but which may be a forced air blower (not shown) or the like. Water input 12 is connected by means of a fitting 34 to a pump or other source of high pressure water (not shown).

As described to this point, the air/water mixer is substantially conventional and operates as follows. Water under relatively high pressure is supplied to inlet 12 and flows through the restrictive orifice 22 which provides a water jet stream. In the absence of the air input to the mixing chamber 18, the water jet stream would flow into the chamber in a converging and thereafter diverging stream of significantly increased velocity as indicated by the dotted lines 40. The water jet entering the restrictive nozzle 32 converges as it enters the nozzle and continues to converge after it leaves the nozzle, reaching a minimum cross section close to but slightly spaced outwardly of the end 42 of the nozzle orifice. Thereafter, the jet stream diverges and its velocity decreases. At the point of minimum cross-sectional area of the jet, the pressure of water in the jet and of the surrounding medium is greatly diminished and, in fact, is sufficiently diminished to pull air into the chamber 18 via the fitting 30 and conduit 32 if such air flow is not blocked (valves for control of such air flow are frequently employed). This is a common venturi type action in which air pulled into the chamber is mixed with the water in the chamber. The water jet, mixed with the air entrained therein, continues to flow from the chamber 18 through the discharge outlet 16, and, thence, through the discharge fitting 24 into the body of water contained in the tub 26, flowing in at a point below the water surface. A substantially similar action occurs if nozzle 22 is not converging but is merely an orifice smaller than the inlet port 12. Thus the terms nozzle and orifice are used interchangeably herein to denote either the converging passage nozzle or a nontapering flow restricting aperture.

According to principles of the present invention, the high velocity mixture of air and water that is discharged through outlet 16 and fitting 24 is caused to pulsate by disturbing the venturi action of the high-velocity jet in the mixing chamber as it exits the nozzle or orifice 42.

Surprisingly and unexpectedly, it has been found that by disturbing the jet stream after it enters the mixing chamber from the nozzle 22, the venturi action is significantly disabled. Air is no longer drawn into the chamber. It is postulated that this disturbance of the jet attenuates the pressure reduction and that the attenuation of the pressure reduction effectively disables the forces tending to draw air into the mixing chamber via fitting 30 and conduit 32. Thus, air is not pulled into the chamber and the jet stream is no longer mixed with air in the chamber. In addition, disturbance of the water flow at or near its point of maximum velocity (the point of minimum cross-sectional area of the jet) significantly increases turbulence of the flow and further destroys any laminar flow that remains. Therefore, the exit velocity and energy of the water stream itself is further diminished. Accordingly, disturbance or mere partial impeding of the water jet exiting from nozzle 22 diminishes the force of the stream that is discharged from the fitting 24 by two mechanisms. Such disturbance decreases aeration of the water jet and increases its turbulence which decreases its velocity.

It has been found that the effect of disturbing the jet by partly impeding its flow is greatly enhanced when jet flow is impeded within a venturi type chamber. On the other hand, flow disturbance is considerably less if the jet is impeded as it is projected into ambient atmosphere, for example. In the embodiments described herein, the jet flow is impeded within a flow chamber.

It should be noted that the water jet discharged from the fitting 24 into the body of water within the tub has a considerably greater force and "action" when it is aerated than when it is not aerated. Thus, merely eliminating the air entrainment of the exiting water jet (without otherwise disturbing it) would itself significantly diminish the force of the exiting water stream. It will be seen, therefore, that momentarily and repetitively cutting off the air supply, without further action, will provide an effective pulsation of the discharge. In the present invention, the effective equivalent of air supply cut off is obtained by disabling the venturi action. Furthermore the effect of decreased air entrainment is enhanced by the momentary and repetitive physical disturbance of the water jet itself. Such disturbance decreases its velocity and increases the turbulence of its flow. Therefore, the physical disturbance by itself, produces both mechanisms of the resulting pulsation.

As illustrated in FIG. 1, disturbance of the water jet exiting the nozzle 22 is achieved by reciprocating a spoiler member into and out of the path of the water jet flow within the chamber so as to momentarily and repetitively partially intercept or interrupt the water jet stream. The water is fed to and through the inlet 12 and the nozzle 22 without disturbance other than that caused by the restrictive orifice. In this embodiment there is employed no flow disturbance (whether flow blocking, flow diverting or driving a turbine or the like) upstream of the nozzle. A guide sleeve 46, open at both ends, is fixedly mounted to and within the air input fitting 30. Slidably mounted for reciprocation within the sleeve is a piston 48 having a depending rod 50 fixed thereto. A stop plate 52 is fixed to and within the air input port 14 and is provided with a number of air-admitting apertures 54. A transverse rod 56 is fixedly mounted at the top sleeve 46, preferably fixed to the sleeve 46, (the rod alternatively may be fixed to the conduit 64 or to the fitting 62) to limit upward motion of piston 48. The piston is urged upwardly by means of a compression spring 60 that encircles the piston rod 50, having opposite ends abutting the piston 48 and the upper surface of the stop plate 52, respectively. Sleeve 48 is provided with a plurality of circumferentially spaced apertures 62 adjacent its upper end.

Piston rod 50, which is the water jet spoiler or flow impeding or obstructing device that disturbs the water jet, is formed of a rigid rod that may be approximately one-eighth to one-quarter inch in diameter, for a jet orifice of about three-eighths inch diameter. The lower end 66 of the rod projects through a central, guiding aperture 51 in stop plate 52 into the mixer chamber 18 when the piston 48 is at or near an uppermost position thereof, which position is illustrated in FIG. 1. In such uppermost position, the piston, which is sealed to and within the sleeves by means of O-rings 64, blocks the air apertures 62.

The piston and its piston rod or spoiler 50 automatically reciprocate, (as will be presently described) repetitively moving between the uppermost position illustrated in FIG. 1 and a lower position illustrated in FIG. 2. In this lower position, the lowermost end 66 (which is the actual spoiler or flow disturbing member) of the piston rod 50 is close to but preferably slightly above the center line 68 of the fixed path traveled by the water jet as it flows through the chamber 18 from the jet nozzle 22 to the mixture outlet port 16. Preferably the spoiler end 66, in its lower position, is positioned axially of the water jet means at the point of least area (and thus the point of least pressure and greatest velocity) of the water jet. Nevertheless, the position of the spoiler axially of the jet stream may be varied considerably without departing from principles of this invention. As will be described below in connection with alternate embodiments, the spoiler need not move vertically (perpendicular to the jet axis) as long as it moves to and from a position in which it at least partly intercepts the jet stream at a point close to but slightly spaced downstream from the jet orifice 42. For example, the spoiler may move at an angle to or rotate about an axis coincident with, offset from or skewed relative to the axis of the mixing chamber. When the spoiler 66 moves to a position wherein it partially impedes or disturbs the flow of the jet stream, the velocity of the stream is decreased, its turbulence is increased and the venturi action is effectively disabled. Disabling of the venturi action causes the device to stop pulling air through the conduit 32 into the mixing chamber, and thus the exiting stream, in addition to being partially obstructed, is no longer aerated.

In operation of the device illustrated in FIGS. 1, 2, and 3, the piston is initially in the position of FIG. 1, being urged to this upward position by the spring 60 and being limited to this position by the stop rod 56. Initially, in the position of FIG. 1, the spoiler 66 of the piston rod 50 is in retracted position wherein it is spaced from and out of the path of the flowing water jet that is projected from the nozzle 22. Application of water under pressure to the mixer input 12 initiates the venturi action of the increased velocity water jet that is projected from the nozzle 22 into the mixer chamber. The increased velocity creates a decreased pressure within the fitting 30 and within the sleeve 46 on the lower side of piston 48. The upper side of piston 48 is open to ambient atmosphere (or higher air pressure if a blower is used) and the pressure difference across the piston is greater than the force exerted by the spring in its extended position. Therefore, the piston is driven downwardly by the ambient air pressure, driving the rod 50 and its spoiler end 66 downwardly toward the water jet flow path. As the spoiler 66 of the piston rod 50 approaches the water jet within the chamber 18, the upper end 70 of piston 48 moves below and unblocks the air apertures 62. In the manner previously described, decreased pressure within the fitting 30 and between the inner surface of the fitting 30 and the outer surface of the sleeve 46 is produced before the spoiler 66 disables the venturi action. Therefore, when the piston 48 unblocks the air apertures 62, this decreased pressure pulls air through the conduit 32 into the upper end of the sleeve 46 and, thence, through the apertures 62, down around the exterior of the sleeve 46, through the air apertures 54 and into the mixing chamber 18 where it is mixed with the water in the chamber.

As the spoiler member 62 enters the path of the water stream and thereby partly obstructs the stream flow, the venturi action is effectively disabled or at least significantly decreased, and the decrease of pressure in the mixer chamber is attenuated (e.g., the pressure rises) to thereby decrease the pressure differential on the piston. The force of the now contracted spring 60, no longer opposing the high magnitude air pressure difference, is sufficient to drive the piston 48 upwardly. The spoiler end 66 is withdrawn from the path of the jet stream to allow the venturi action to once again produce a lowered pressure within the fitting 30 and within the chamber 18. When the spoiler 66 is retracted, the water jet, no longer obstructed by the spoiler, again flows with increased velocity and entrains air that is within the mixing chamber. The increased velocity once again produces the venturi action and decreased pressure to draw air into the mixing chamber. At the end of one cycle the piston attains its upper position wherein it again blocks the air apertures 62 to enable build up of a pressure differential across the piston and the cycle repeats itself, continuing to repetitively and automatically reciprocate the spoiler. In a model that has been initially tested, the reciprocation rate of the piston and spoiler is in the range of 60–300 cycles per minute under water pressure of about 25 pounds per square inch, a pressure commonly used in therapy pool mixers.

It is found that the size of the mixing chamber affects the repetition rate of the automatically reciprocating piston and spoiler. Increasing the length of the chamber or, more specifically, extending the length of the mixer output 16 effectively decreases the reciprocation rate, whereas decreasing its length increases the reciprocation rate. Accordingly, the discharge end of the chamber is made of two threadedly engagable portions **16*a*, 16*b*** to thereby enable adjustment of the size of the mixer chamber and the pulsation rate of the discharged air/-water mixture.

Although a slender rod tip has been shown as a presently preferred form of spoiler in this embodiment, the size or shape of the spoiler may vary widely. The slender rod tip does effectively produce the desired pulsation with relatively little overall decrease in the volume of water flowing through the mixer with a minimum of impedance to water flow when in retracted position. Nevertheless, the spoiler may be larger, it may be of other than cylindrical configuration, or it may be in the form of a flat or curved inclined deflector plate. In the latter configuration, impingement of the jet upon an inclined plate carried at the end of piston rod 40 would create a component of force direction upwardly (with the plate properly inclined) along the axis of the piston rod 50 and thus such inclined disturber plate would assist or replace the spring in returning the piston to its upper position. The spoiler 66 may move entirely across the full width of the stream and, as previously mentioned, its position axially of the stream may be varied considerably from that shown, being either closer to or further from the orifice 42 of jet nozzle 22 without departing from principles of the present invention. It will be observed that the described arrangement provides for an effective pulsing of the discharging air/water mixture without blocking any of the water flow either upstream or downstream of the jet nozzle 22. Although air flow is momentarily blocked in this embodiment (but not in others to be described below) such blockage is primarily for the purpose of automatically reciprocating the spoiler. No remote control is needed, although if deemed necessary or desirable, reciprocation of the piston could be remotely controlled as by means of a remotely positioned water operated turbine or the like or an electrically actuated solenoid or equivalent apparatus.

The water jet stream within the mixer chamber can be momentarily and repetitively disturbed by many different mechanisms. The automatically reciprocating arrangement of FIGS. 1–3 is illustrative of one type of such disturbing mechanism. Illustrated in FIGS. 4, 5, 6, and 7 is another type of disturbing mechanism in which the flow disturbing spoiler is rotated within the mixer chamber. This operation also adds a swirling action to the discharge, imparting a spiral flow to the pulsating mixture of air and water as it exits the mixer. As shown in FIGS. 4–7, a mixer body 110 is formed with a water inlet passage or port 112, an air inlet passage or port 114 and a mixer discharge port or passage 116. A mixing chamber 118 is defined within the mixer body in communication with the ports 114 and 116 and is separated from the water inlet port 112 by a partition or plug 120 having a restricted orifice forming a water jet nozzle 122. Partition 120 is threaded and has one or more tool receiving recesses 124 to enable removal and replacement from the discharge end of the mixer body. Orifice 122 is offset from the center of the chamber 118 and from the center of the elongated generally circular and symmetrical mixer body in an upward direction (as viewed in FIG. 4) so as to be closer to air input port 114. Outlet port 116 is adjustably extensible in length by means of a threaded end member 117. Member 117 is connected to a tub wall and discharge fitting (not shown in FIGS. 4–7) similar to the tub wall and discharge fitting 24 of the previously described embodiment. As in the previous embodiment, air inlet 114 is connected by a fitting 130 and a conduit 132 to a source of air, and water input 112 is connected by means of a fitting 134 to a pump or other source of high pressure water (not shown).

Output passage 116 is axially elongated and rotatably mounts a water driven turbine or rotor generally indicated at 140. Rotor 140 comprises a hollow sleeve 142 rotatably mounted within the elongated circular output passage 116 and positioned axially between a downstream stop collar 144 threaded within and removably secured to the inside of the output passage and the downstream side of partition 120.

The downstream end of the rotor sleeve 142 fixedly carries a plurality of inwardly extending, angularly directed, turbine blades 150, 152, 154, 156. The other end of the turbine or rotor sleeve, the end adjacent partition 120, is formed with a plurality of circumferentially spaced, air-admitting apertures 158, 160, 162, etc., all positioned to communicate with the air inlet 114.

Fixed to the inside of rotor sleeve 142, extending for a short distance along the circumference of the inner surface thereof, and projecting radially inwardly therefrom, is a spoiler blade 168. The blade is a relatively short, generally flat element having its upstream surface lying in a plate that extends at an angle to the axis of the rotor and thus at an angle to the axis of a water stream flowing through and from the jet orifice 122. The upstream end of the rotor sleeve and thus the upstream surface of the spoiler 168 is positioned closely adjacent to but slightly spaced from the exit of the orifice 122.

Water under pressure, applied continuously and generally without disturbance to the inlet port 112, flows with increased velocity, diminished area and diminished pressure through the restrictive orifice 122 into the mixer chamber 118 in a manner substantially similar to that described in connection with FIGS. 1–3. The increased velocity and decreased pressure jet stream flowing in mixing chamber 116 produces a vacuum that operates to pull air into the mixer chamber via the conduit 132 and fitting 130 and through openings 158, 160, etc., of the rotor sleeve 142. As the water stream passes through the mixer chamber and through the interior of the rotor, it impinges upon the blades 150, 152, etc., causing the entire rotor to rotate. As the rotor rotates, the spoiler moves in a circular path, at one point of which at least a portion of the spoiler partly intercepts the water jet at exiting nozzle 122. The spoiler may either partly or fully intercept the jet. With the spoiler in the path of water from the exit orifice, the jet stream is at least partly obstructed (but not stopped), its laminar flow disturbed, and the vacuum produced by venturi action is effectively disabled. Therefore, as in the previous embodiment, the force of the exiting water is diminished, and in addition, the exiting water is not aerated, thereby still further diminishing its force.

Continued rotation of the rotor moves the spoiler from its obstructing position to a series of positions throughout the major portion of its rotating path wherein the jet stream flows, unimpeded by the spoiler, from the orifice into and through the mixing chamber. This unimpeded flow has greater velocity and reduced pressure to provide greater force of the aerated, unimpeded discharge. In addition, the action of the turbine blades causes the discharged pulsating mixture to follow a spiral path, which still further enhances the benefits attained.

The spoiler blade 168 may be a thin rod-like member similar to rod end 66 of FIGS. 1–3. However, its width and inclination relative to the water jet axis afford a greater disturbance of the water jet, allowing greater manufacturing tolerances, and also act as an auxiliary turbine vane, aiding in the rotational turbine drive when the water jet impinges upon the spoiler. It is desirable to make the turbine blades as small as possible without loss of adequate rotation, so as to maximize water flow through the mixer.

A significant advantage of the arrangement of FIGS. 4–7 is the fact that the entire pulsation producing mechanism (e.g., the rotor and its spoiler) can be inserted from the discharge end of the mixer. This not only facilitates repair and replacement, but enables many type of standard air/water mixers to be retrofitted for pulsation, even without removing the mixer from a tub in which it had previously been installed. For example, mixers of the type shown in the Steimle U.S. Pat. No. 3,628,529 have a nozzle that is threadedly connected to and within the mixer body and may be readily removed from the discharge end of the mixer by removing the discharge fitting. Thus, one need only remove the existing nozzle having a centrally positioned jet orifice, replace this nozzle with one in which the orifice is offset from the center of the mixing chamber (as illustrated in FIGS. 4–7, for example), and then insert a rotor and spoiler into the mixing chamber with the spoiler positioned to intercept the increased velocity water stream that is projected from the now offset nozzle. If deemed necessary or desirable, the discharge fitting may also be slightly modified to provide additional length of the mixing chamber if this be required. In some existing air/water mixers, such as that shown in the U.S. Pat. No. to Mathis 3,890,656, the jet nozzle is already offset from the central axis and thus the nozzle need not be replaced, but one need merely insert the rotor and spoiler as previously described. in such retrofitting, the discharge fitting, such as the outlet 19 of Mathis U.S. Pat. No. 3,890,656 or the nozzle socket fitting 32 of Steimle U.S. Pat. No. 3,628,529 may either be shortened or replaced with a corresponding element of configuration suitably modified to accommodate the rotor and spoiler that is to be added.

Figure 4:
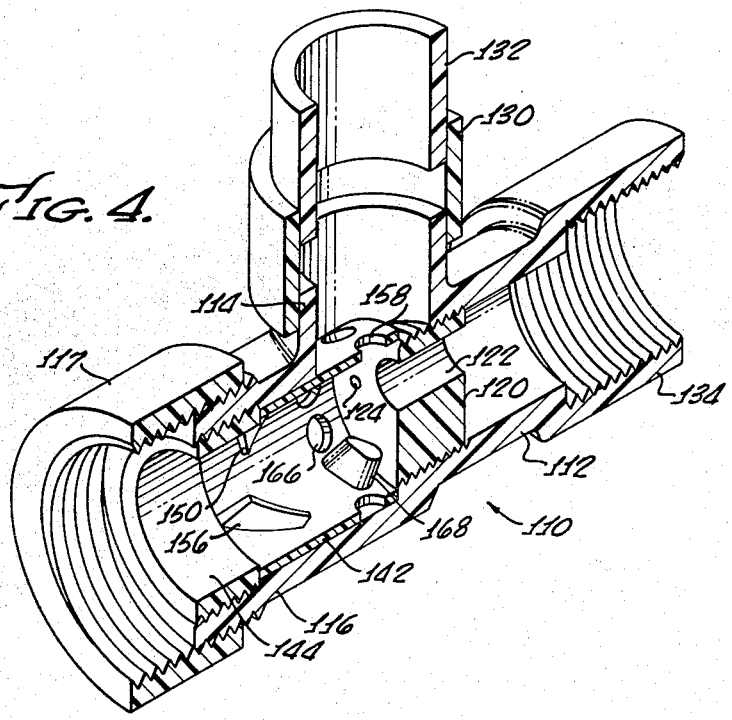
FIG. 4 is a pictorial view, with parts cut away, of a modified pulsating air/water mixer.

For replacement or repair of components of the embodiment illustrated in FIG. 4 without removing the fitting from a tub wall to which it may already be secured, one need merely remove the discharge fitting and the collar 144 whereupon the rotor and spoiler may be readily removed and replaced, if necessary. Further, the nozzle bearing partition 120 may also be readily removed and replaced via the readily accessible discharge end of the mixer body, as mentioned above.

The embodiment of the invention illustrated in FIGS. 1–3 in general provides less restriction to overall flow of water than that illustrated in FIGS. 4–7, particularly because of the use in the latter of the turbine to drive the spoiler. The rotor vanes provide additional restriction to flow of water through the mixer body. However, as previously mentioned, the embodiment of FIGS. 4–7 has the advantage of access to the working mechanism from the discharge end and the capability of retrofitting to existing mixers. Illustrated in FIG. 8 is an arrangement that is basically similar to the embodiment of FIGS. 1–3, but modified to enable the working mechanism to be accessible for repair and replacement from the discharge end of the mixer body. In this arrangement, the mixer body 210 is formed with a water inlet passage or port 212, an air inlet passage or port 214, and a mixture discharge port or passage 216. A mixing chamber 218 is defined within the mixer body in communication with ports 214 and 216, and is separated from water inlet port 212 by a partition 220 having a restrictive orifice in the form of a tapering water jet nozzle 222. The outlet port 216 is connected to a discharge fitting (not shown) in a manner similar to that shown in FIGS. 1–3.

In this arrangement, there is interposed between the air inlet 214 and the discharge passage 216 a working chamber 224 formed by an upper wall 226 and a back wall 228. Chamber 224 is open at its forward end for communication with the air inlet 214. Mounted within the chamber 224 and extending rearwardly from the air inlet in a direction substantially parallel to the discharge passage 216 for abutment with a fixed stop 245 is a hollow sleeve 246. Mounted in sleeve 246 is a piston 248 having a piston rod 250 fixed thereto. Pivotally connected to an end of rod 250 at a point 251 is a spoiler rod 254 having an end 266 positioned to cyclically move into and out of the path of a stream of water projected from nozzle 222. Rod 254 extends through an aperture in the upper wall of mixing chamber 218, the aperture being defined by walls 268, 270, each of which has upper and lower tapered surfaces that permit a sliding and angular shifting motion of the piston rod 254 through the aperture defined between the wall portions 268 and 270. The inclination of these wall portions also facilitates the complete withdrawal and the insertion of the piston rod 254 through the aperture into the mixing chamber. A spring 260 circumscribes the piston rod 254 and is interposed between one surface of the piston and an inwardly directed circumferential flange 262 at one end of the sleeve 246 to continually urge the piston forwardly (to the left as viewed in FIG. 8).

Access to the interior of chamber 224 from the discharge end of the mixer is provided by a threaded and removable access plug 270 having a piston stop later 256 fixed thereto by means of an integral rod 258. Plate 256 bears against the forward end of the piston and is formed with a plurality of air admitting apertures 261 that cooperate with air admitting apertures 264 in an end of sleeve 246 and with apertures 263 in an upper wall of mixer chamber 218 which separates this chamber from the working chamber 224.

The arrangement illustrated in FIG. 8 operates in the same manner as the embodiment of FIGS. 1–3. Piston 248, normally in a position to the left of that illustrated in FIG. 8, as urged by spring 260, blocks air apertures 264, and retracts spoiler member 266 from the path of the water jet projected from the nozzle 222. An increased velocity water jet from the nozzle creates a decreased pressure within chamber 218 and also within chamber 224 and the interior of sleeve 246, creating a pressure differential across the piston to drive the piston toward the right as viewed in FIG. 8. Motion of the piston toward the right shifts the rod 254 causing it to pivot about its loose and slidable connections with the aperture forming wall sections 268, 270, and also causing it to move slightly downwardly into the path of the projected jet stream. In an initial position of the piston, its left-most position, the spoiler 266 is retracted, out of the path of the jet stream. As the piston unblocks the apertures 264, air is drawn into the chambers 224 and 218, the water jet is disturbed to disable the vacuum created by the venturi action, and the spring returns the piston to its left-most position, retracting the spoiler 266.

As previously mentioned, the arrangement of FIG. 8 has the advantage of enabling access to the entire pulsing mechanism simply by removal of the sealing access plug 270 which then exposes the piston for ready removal. The piston may simply be withdrawn through the aperture in which the access plug had been mounted and as the piston is withdrawn, the piston rod and spoiler rod 254 are also withdrawn. The sleeve 246 may also be readily removed and replaced. Replacement of the mechanism entails following the reverse procedure, inserting the rod 254 and piston into sleeve 246 within the working chamber 264 and into sleeve 246 therein through the access aperture. The tip of rod 254 is allowed to drop by gravity into the aperture between the wall sections 268 and 270. A suitable tool receiving aperture, recess or other arrangement may be provided on the piston to facilitate insertion, withdrawl, and rotation of the piston and rods 250, 254 as may be necessary for replacement. If deemed necessary or desirable, the piston rod 250 and rod 254 together with its spoiler end 266 could be made of a slender flexible and integral curved member which extends from the piston in an arc, curving rearwardly, (toward the right in FIG. 8) and downwardly through the aperture between wall sections 268 and 270. In such an arrangement, reciprocation of the piston would effect both a bending of the slender curved member and a reciprocation of its spoiler end into and out of the path of the jet stream from the nozzle 222.

Illustrated in FIGS. 9 and 10 is still another embodiment of a pulsating mixer in which pulsation is caused by a rotor driven reciprocating spoiler. A mixer body 310 is formed with a water inlet passage or port 312 and an air inlet passage or port 314. In this case, an auxiliary water passage 313 is formed offset from the main water passage 312 and defined by walls 326, 328, being separated from the primary water passage by a wall 330. A partition 320 in the auxiliary water passage 313 is formed with a tapering jet nozzle 322 to project an increased velocity water stream into a mixer chamber 318. Mixer chamber 318 communicates with the mixer discharge passage 316 and, via an aperture 319, to air input port 314. A hollow rotor 342 having vanes such as those indicated at 350 is rotatably mounted in water passage 312 and is formed with a plurality of apertures 352 in communication with apertures 354 formed in the wall 330 to permit water to flow through the rotor from water passage 312 into the auxiliary water passage 313.

A pin 360 is fixed to the forward end of rotor 342 and offset from the center thereof. Journaled on the pin about an axis parallel to the axis of the rotor is an eccentric rod 362 extending into the mixing chamber 318 and having a lowermost end 366 which is positioned (at a lowermost position of rotation of the eccentric rod 362) in the path of a water stream projected by the nozzle 322. Water passage 312 extends forwardly to the discharge end of the mixer body and is sealed at the forward end by means of a threaded and removable access plug 370. Rotor 342 is held in position by a removable stop pin 372 and is formed with one or more tool receiving recesses 374 to facilitate insertion and removal of the rotor from the discharge end of the mixer. The parts are proportioned so that the eccentric rod 362 will clear the access opening of plug 370 for insertion and removal when the rotor is positioned to place the pin 360 at a point furthest from the nozzle 322.

In this arrangement, water flows through inlet passage 322, impinges upon rotor vanes 350 to rotate the rotor, flows into chamber 313, and through nozzle 322 from which it is projected with increased velocity stream into mixing chamber 318. Rotation of the rotor causes reciprocation (upwardly and downwardly as viewed in FIG. 9) between an uppermost position in which the spoiler 366 is displaced from the jet stream in chamber 318 and the lowermost position where the spoiler is in the path of the stream (the lowermost position being illustrated in FIG. 9). Although only a very short distance of retraction of the spoiler is required and only such a short distance is employed in the embodiments of FIGS. 1–3 and 8, the arrangement of FIGS. 9 and 10 provides a greater distance of spoiler reciprocation. This is required not for operation of the pulsating action, but in order to enable insertion and replacement of the rotor and its eccentric rod.

As in the embodiments illustrated in FIGS 1–3 and 8, reciprocation of the spoiler 366 into and out of the path of the jet stream both decreases the energy of the exiting mixture and decreases the entrainment of air therein, all repetitively and intermittently.

Figure 11:
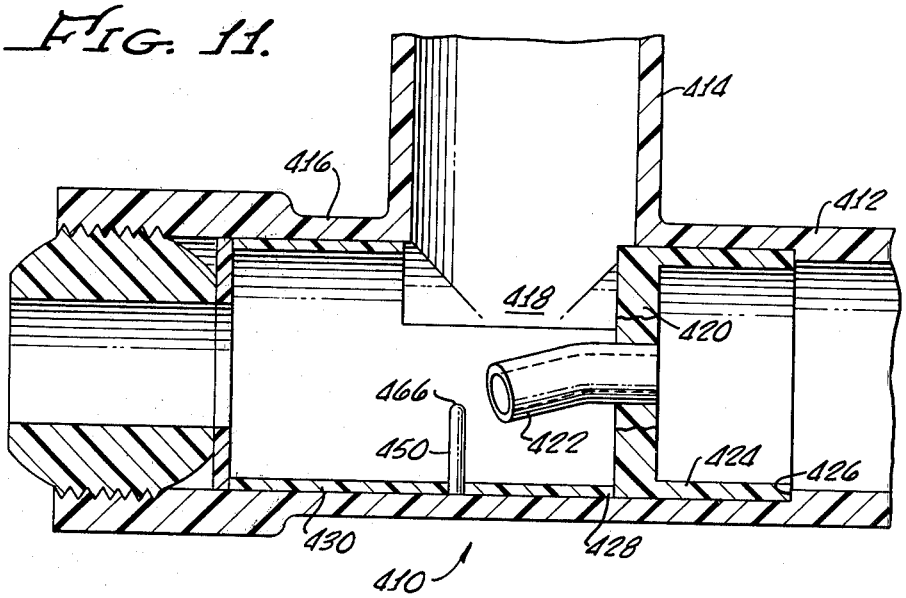
FIGS. 11 and 12 show a form of pulsating air/water mixer having a rotating water jet and a fixed flow disturbing member.
Figure 12:
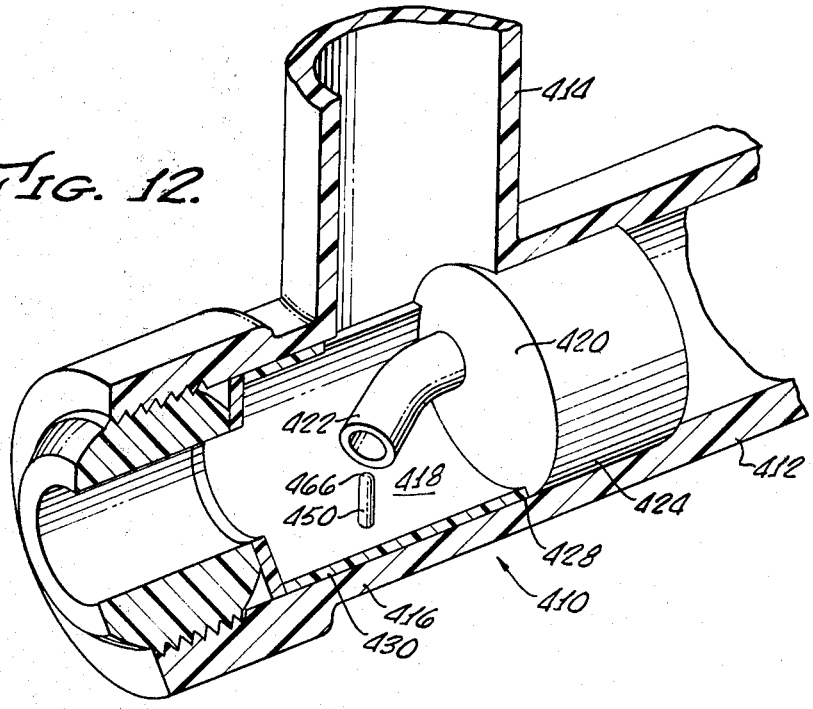

Although principles of the invention have been embodied in preferred arrangements wherein an increased velocity water jet is projected along a fixed path and a spoiler is intermittently moved into and out of such path, it will be readily appreciated that principles of the invention merely involve repetitive and intermittent disturbance of the jet stream. Thus, one may use a fixed spoiler and cause the jet stream to move in a path that is intermittently intercepted by the fixed spoiler. Thus, as illustrated in FIGS. 11 and 12, a mixer body 410 having a water inlet passage 412, an air inlet passage 414 and a discharge or outlet passage 416 is formed with a mixing chamber 418 that is separated from the water passage by a partition 420 and communicates with both the air inlet 414 and the discharge passage 416. In this arrangement, partition 420 includes a rearwardly extending sleeve portion 424 that journals the entire partition within the water passage for rotation about a centrally positioned longitudinal axis of the mixer body. The rotatable partition is maintained in its axial position within the mixer body by abutment of a rearmost or upstream end with a shoulder 426 of water passage 412 and with a rearmost end 428 of a stop sleeve 430 that is detachably positioned within the discharge passage 416 and chamber 418.

Rotatable partition 420 is formed with a forwardly projecting tube that defines a jet nozzle 422. Nozzle 422 extends from a point on the partition 420 that is offset from the center of rotation of the partition. Not only is the nozzle 422 offset, but the axis of a forward, bent part of the nozzle 422 is inclined in a plane parallel to and offset from a plane containing the center of rotation of the partition 420. With this offset and inclined arrangement of the nozzle 422, water flowing through the nozzle imparts a rotational driving force thereto which causes the entire partition 420, together with nozzle 422, to rotate about the central axis of the partition and mixer body. Thus, the nozzle provides a skewed, nonlinear water passage that creates an increased velocity stream of water projected in a rotating path.

A spoiler in the form of a pin 450 having a flow disturbing tip 466 is fixedly mounted within the mixing chamber 418 so that the spoiler tip 466 intercepts the jet stream in one position of the stream as the stream rotates around and within the mixing chamber. Conveniently, the spoiler 450 is a small diameter rod that may be fixedly mounted for projection radially inwardly from the stop sleeve 430.

In operation of the arrangement of FIGS. 11 and 12 water flowing into the inlet 412 through the bent nozzle 422 reacts against the nozzle as the water direction is changed by the inclination of the nozzle. This causes the partition and nozzle to rotate. Therefore, the jet stream projected by the nozzle rotates in a conical path within the chamber. One element of this conical path is intercepted by the spoiler 466 and thus the rotating stream is repetitively and intermittently disturbed by the fixed spoiler. Just as previously described, disturbance of the stream attenuates or disables the venturi action, air is no longer drawn into the mixing chamber 418 from the air inlet 414 and for a short interval of time, the discharged mixture is a body of water of decreased energy and having considerably decreased entrained air. Obviously, other types of spoilers may be employed and many other arrangements such as vanes, bent or otherwise angulated nozzles and the like may be employed to effect cyclic movement of the jet stream whether in a circular, linear or conical path.

As previously mentioned, those embodiments which are operated by air pressure difference across a piston operate at a reciprocation rate that is adjustable by adjusting the size of the mixing chamber. For those embodiments in which a rotating jet stream is caused to impinge upon a fixed spoiler or in which a rotating spoiler is caused to interrupt a fixed stream path, repetition rate of the pulsation can be increased by positioning additional spoilers in the stream path. For example, the rotor of FIGS. 4–7 may be caused to carry two or more spoilers whereby stream interruption will occur two or more times for each rotational cycle and the rotating nozzle embodiment of FIGS. 11 and 12 may be caused to pulsate at increased rates by positioning two or more spoiler members spaced (preferably equally spaced) circumferentially around the chamber.

Illustrated in FIGS. 13, 14, 15, and 16 is still another embodiment of a pulsating mixer in which pulsation is caused by a rotor having blades journaled directly upon the mixer nozzle. As best seen in FIGS. 13 and 14, a mixer of the type shown in the above-identified pending application of Gerald Moreland, has a mixer body 510 formed with a water conduit 511, positioned parallel to and alongside of an air conduit 513. The water conduit has a water inlet passage or port 512 and a water outlet or port 512*a*. The air conduit has an air inlet passage or port 514 and an air outlet passage or port 514*a*. A tapering jet nozzle 522 is detachably threaded into a common wall 515 of the mixer body, communicating with the water conduit 511 and extending a short distance into and radially of the air conduit 513. The nozzle projects an increased velocity water stream diametrically across the air conduit 513 and, thence, into and through a mixer discharge passage 516 fixed to the air conduit 513 and substantially coaxial with the jet nozzle 522.

In the operation of this mixer, water under pressure is applied to the input end 512 of the water conduit 511 and flows through the conduit to exit therefrom via water conduit outlet 512*a*. Similarly, air flows into air inlet 514 of the air conduit 513, through the air conduit and, thence, out of the air conduit via air outlet port 514*a*. Pressurized water in the water conduit 511 flows through the jet nozzle and is projected across the air conduit 513 and into the discharge passage 516. From passage 516 the stream flows into the mixer output fitting (not shown in FIG. 14) which may be a substantially conventional fitting of the type shown in other embodiments herein. The increased velocity stream of water provides a venturi action, as previously described, and thereby entrains air from the interior of the air conduit which surrounds the orifice of the jet nozzle for substantially 360°. Thus, a mixture of water and air is projected into the discharge passage 516 for discharge from the mixer.

In this embodiment a flow disturbing member or spoiler in a form of an inclined spoiler blade 524 of a rotor 525 is fixedly attached to a rotor hub 526 that is rotatably mounted upon a headed shaft 528. The shaft is mounted upon and protrudes generally axially from the downstream face of the tapered jet nozzle 522. Conveniently, the shaft 528 comprises a headed bolt having a threaded body that is engaged in a tapped aperture formed in the downstream facing nozzle surface at the edge of the jet nozzle. In order to insure a self-starting action, hub 526 carries a second blade 530 that extends from the hub in a direction nearly opposite from the direction of extent of the primary blade 524.

Blade 524 has an inclined surface 532 upon which the water jet from the nozzle impinges. Surface 532 is inclined in a direction generally axially of the projected water stream, whereby impingement of water on the surface 532 creates a tangentially directed force that rotates the entire rotor, comprising the hub and the two blades, about the axis of shaft 528. The primary blade 524 has a length sufficient to cause the outermost end 534 thereof to extend substantially entirely across the aperture of the jet nozzle in one position (see FIG. 15) of rotation of the rotor.

Once rotation of the rotor has begun, the single primary blade 524 is all that is needed to maintain the rotation (as long as the jet nozzle projects its increased velocity water stream) and to repetitively interrupt the water stream. However, to insure a self-starting operation, the auxiliary blade 530 is provided and, in a presently preferred embodiment, has a significantly lesser radial extent than the primary blade. The auxiliary blade also has an inclined surface adapted to respond to impingement of water from the jet nozzle to impart a rotation to the rotor.

The water receiving surfaces of the two blades generally extend in radial directions that are angularly displaced from another by less than 180°, as can be best seen in FIG. 15. The nozzle is installed so that the pivot shaft 528 is at or near an upper portion of the nozzle in normal nozzle orientation. With such an arrangement, when the rotor is at rest it will assume the position illustrated in FIG. 15, with the primary blade 532 hanging downwardly from the shaft and, therefore, extending across the nozzle orifice. However, in substantially all positions other than the position illustrated in dotted lines in FIG. 15, one or the other of the blades 524, 530 will extend at least partially across the nozzle orifice and, therefore, be in position to start rotation upon initiation of the water stream from the jet nozzle.

Importantly, the described angular relation of the two blades provides at least one position (the position illustrated in dotted lines in FIG. 15) in which neither blade obstructs the jet nozzle orifice so that in such one position the jet stream is unimpeded and not even partially blocked. Such a position is desirable in order to allow the venturi action to pull increased air into the mixer.

As best seen in FIG. 16, the axis of rotor shaft 528 is skewed relative to the jet nozzle axis and, presuming the jet nozzle axis to be horizontal, the shaft axis lies in a horizontal plane spaced from the nozzle axis. The shaft axis is inclined in such plane and thus is skewed relative to the nozzle axis by an acute angle, as can be seen in FIG. 16. It is found that this inclination of the rotor shaft axis decreases vibration that may exist when the rotor is mounted on an axis that is parallel to the nozzle axis. Other directions of inclination may be employed, although it is preferable that the rotor shaft be inclined either outwardly or laterally, but not inwardly toward the nozzle axis.

As mentioned above, the rotor may have but a single blade, although, use of the second auxiliary blade is preferred to assist in a self-starting operation. Three or more blades may also be employed, provided, however, that the positioning of the rotor and the configuration of the blades are such as to allow rotation of the blades to at least one position in which the water stream projected by the jet nozzle is completely or substantially free of obstruction or interruption. For example, a three or four blade rotor may be journaled upon an axis spaced further from the jet nozzle axis than the spacing of the rotor journal illustrated in FIGS. 13 through 16. However, use of a rotor journal that is positioned relatively close to the nozzle axis, as in the embodiment illustrated in FIGS. 13 through 16, may make it difficult to design a rotor having more than two blades and with which the projected jet would be free of obstruction or interruption at some point in the rotation of the blade.

In operation of the embodiment of FIGS. 13 through 16, water under pressure is provided to the water conduit 511 via water inlet 512, and flows out of the water conduit from outlet 512*a* to a connecting water line (not shown) that may connect to a second mixer. Air from an air line (not shown) flows under pressure from an air blower (not shown) or from ambient atmosphere to air conduit inlet 514 through the air conduit 513 and then out from the air outlet 514*a* to a connecting air line (not shown) that may be connected to another mixer. Water from the conduit 511 is projected through the nozzle 522 as a water jet of increased velocity, along a path extending across the air conduit 513 and axially of the mixer discharge passage 516.

The projected water jet impinges upon primary rotor blade 524 and upon the inclined surface 532 thereof causing the entire rotor, that is both blades 524 and 530 and the hub 526, to rotate about shaft 528. Water also impinges upon the auxiliary blade 530, also producing a component of the rotation inducing force. As the rotor turns, the blade 524, and also the blade 530, periodically and momentarily disturb the projected water jet and thus disturb the venturi effect thereof, thereby producing a pulsating action as described above in connection with the earlier described embodiments. With the two blades angulated relative to each other, as disclosed herein, the water stream projected from the jet nozzle is undisturbed for a significant portion of the rotation of the rotor and thus, during this undisturbed rotation portion, the maximum venturi action can take place and a jet of maximum force can be discharged from the mixer. With the described relation of the two rotor blades, the projected water jet may remain undisturbed for an angular distance almost equal to but somewhat less than 180°. Increasing the radial distance between the jet nozzle axis and the rotor axis will increase the angle of blade rotation during which the water jet is undisturbed.

The rotor of FIGS. 13 through 16 has a greater speed and will provide a greater frequency of pulsation then embodiments previously described. Adjustment of this rotor speed may be readily provided by various arrangements, such as increasing the frictional engagement between the rotor hub 526 and the shaft head on one side of the hub and the nozzle face on the other side of the hub. This can be achieved merely by threading the shaft further into the nozzle face. Turning the shaft so as to move the shaft head further outwardly to allow the entire rotor to move generally axially away from the nozzle will decrease rotor frequency. Also changing the actual or relative configuration and pitch of the two blades will affect speed of rotation.

A significant advantage of the embodiment of FIGS. 13 through 16 is the ease of installation and retrofitting of the pulsation producing mechanism. Standard mixers of the type illustrated in FIGS. 13 and 14 commonly are produced and sold without the rotor or rotor shaft, but with a nozzle detachably mounted by threaded or bayonet-type connections. Such mixers may be readily retrofitted for pulsation merely by removing the existing jet nozzle and replacing it with a substantially similar jet nozzle upon which has been mounted the described rotor and its spoiler blades. In the arrangement of FIGS. 13 and 14, the end of the nozzle, and thus the entire rotor, are mounted directly in the air conduit 513. Thus, pressure variation due to the intermittent disturbance of the venturi action is maximized and it is not necessary for the repetitive pressure variations to be transmitted through a relatively long path of compressible air. In such an arrangement the pressure variation is of a relatively greater effect.

The interior of the air conduit 513 immediately surrounding the jet nozzle and between the jet nozzle and discharge passage 516, forms a mixing chamber for this mixer and at the same time provides the air supply for the venturi action. Thus, the pressure variation caused by the intermittent disturbance of the water jet not only occurs within the mixing chamber but occurs directly at or within the air source itself and such pressure variation is more effective in varying air entrainment.

Figure 17:
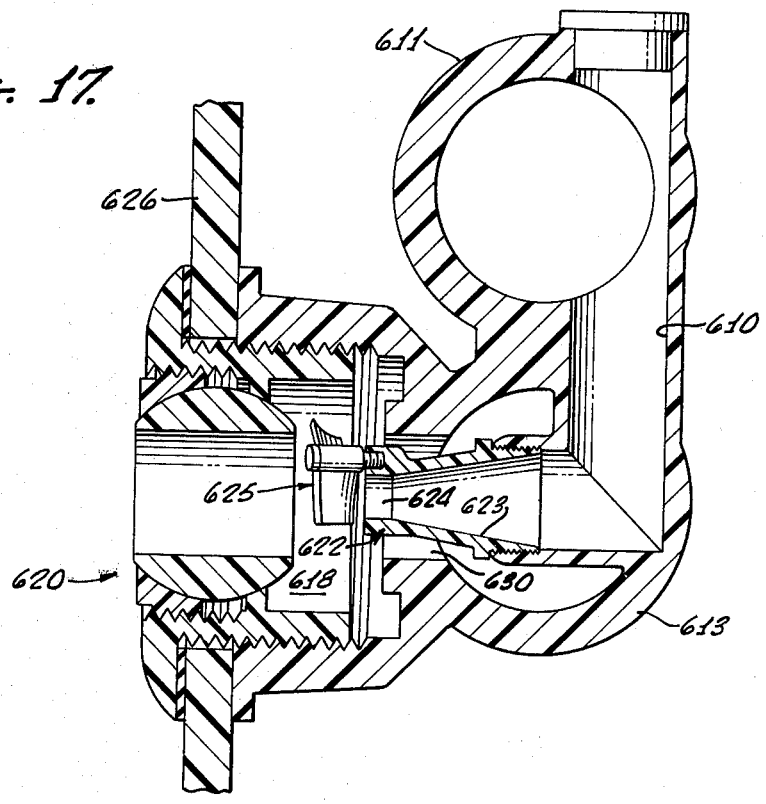
FIG. 17 is a cross section showing another form of mixer having a rotatable spoiler mounted on its jet nozzle.

Illustrated in FIG. 17 is an arrangement using a different mixer body having a jet nozzle identical to or substantially similar to the jet nozzle 522 of the embodiment of FIGS. 13 and 14. This nozzle has mounted thereon a rotor 625 that is identical to the rotor 525 of FIGS. 13 and 14.

In the mixer of FIG. 17, the mixer body comprises a water conduit 611, connected via a connecting passage 610, with an air conduit 613 in which is mounted a tapered jet nozzle 622, having a tapering portion 623, terminating in a substantially straight nozzle portion or orifice 624. In this arrangement the water jet is supplied from the pressurized water in water conduit 611 and connecting passages 610, projected from the nozzle 622, to and through the mixer chamber 618, and, thence, through the discharge aperture in the discharge fitting 620 that secures the mixer body to a tub wall 626.

By means of the venturi action of the increased velocity water stream projected from the nozzle, air is drawn into the mixing chamber 618, from the air conduit 613 and via an annular connecting passage 630 that surrounds the nozzle 622. In the arrangement of FIG. 17, the relatively large size of the mixing chamber 618, together with the passage 630 that in effect separates the mixing chamber from the source of air within the air supply conduit 613, may degrade efficiency of the transmission of pressure variation within the mixing chamber (caused by the intermittent disturbance of the venturi jet) to the air supply. Thus, the variation of air entrainment compared with the arrangement of FIGS. 13 and 14 may be somewhat less. Stated otherwise, the arrangement of FIG. 17 provides an action that may be felt by a user within the spa in which such a mixer is installed as more of a vibration than a pulsation, whereas the jet produced by the mixer with a rotary spoiler of FIGS, 13 and 14, may be felt by the user more as a pulsation than a vibration. It is postulated that this difference in subjective effect may be due to the greater pressure variation and venturi disturbing effect produced within the mixer body of FIGS. 13 and 14.

Figure 18:
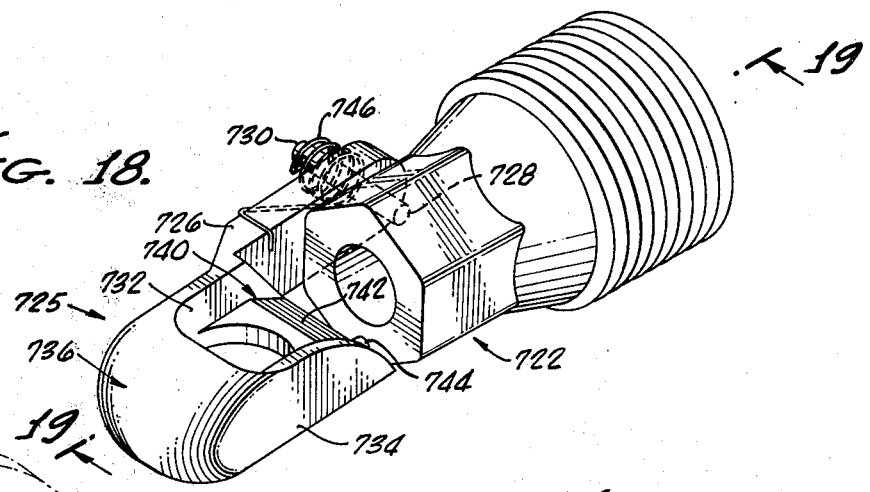
FIG. 18 is an enlarged perspective of a portion of a mixer nozzle having a modified form of reciprocating spoiler mounted thereon.
Figure 19:
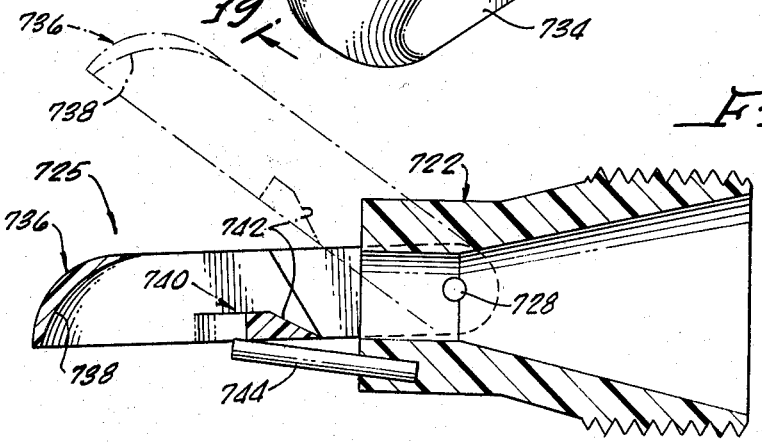
FIG. 19 is a cross-sectional view of the apparatus of FIG. 18.

Illustrated in FIGS. 18 and 19 is a modification of a nozzle mounted flow disturber of FIGS. 13 through 17. A nozzle 722, only a portion of which is shown in FIGS. 18 and 19, which may be identical to or essentially similar to nozzle 622 of FIG. 17, may be mounted in a mixer of any of the types previously described. The nozzle carries a pivotally oscillatable flow disturber 725 formed of a spoiler body having a mounting arm 726 that extends generally alongside of and forwardly of the nozzle. An upstream end of arm 726 is pivoted upon a shaft 728 that has an inner end fixed to the nozzle and a head 730 on an outer end thereof. The spoiler body includes a pair of mutually spaced parallel leg portions 732, 734, extending forwardly from the support arm 726 and interconnected by a transversely extending bight or primary blade 736. Blade 736 has a curved or inclined surface 738 that is positioned, in one limiting position illustrated in FIG. 19, in the path of the high velocity water jet that is projected from the nozzle 722.

Interconnecting the innermost end (the end adjacent the nozzle) of leg 734 with an inner end of leg 732 is an auxiliary blade 740, having an inclined surface 742 inclined in a direction opposite the direction of inclination of the surface 738 of primary blade 736. A stop pin 744, fixed to the nozzle, extends forwardly to be contacted by the auxiliary blade 740 and, thus, limits pivotal motion of the spoiler in a counterclockwise direction, as viewed in FIG. 19, to the position illustrated in this figure. The spoiler is urged to the limiting position of FIG. 19 by means of a spring 746, wound about shaft 728, captured between the shaft head 730 and the spoiler support arm 726, and having an end portion bent around the arm 726 to urge the spoiler against the stop 744. The spring exerts a relatively light force upon the spoiler.

Like the spoilers previously described, the spoiler of FIGS. 18 and 19 automatically reciprocates or oscillates between one position (the position illustrated in solid lines in FIG. 19) in which it disturbs or interrupts the increased velocity water stream and a second position (illustrated in dotted lines in FIG. 19) in which both of the spoiler blades are displaced from and out of the path of the jet stream.

The spoiler of FIGS. 18 and 19 operates as follows: impingement of the jet stream upon the primary blade 738, when the spoiler is in the position of FIG. 19, drives the entire spoiler in a clockwise direction about the axis of pivot shaft 728 to the dotted line position of FIG. 19, wherein the jet stream may flow unimpeded by both blades and the venturi action is undisturbed. Spring 746 urges the spoiler in a clockwise direction from the dotted line position, toward the limiting position shown in FIG. 19 in solid lines. As the spoiler moves in a counterclockwise direction from its displaced position (shown in dotted lines) to an intermediate position, wherein the jet stream impinges upon the inclined surface 742 of the auxiliary blade, the counterclockwise drive of the spring is assisted by the force of the water. This action of the auxiliary blade 742 begins at an intermediate spoiler position in which the primary blade 736 has not yet returned to block or partially impede the water flow and where the surface 742 of the auxiliary blade has greater inclination to the water jet axis. Thus, the spoiler is returned to its full flow disturbing position, illustrated in solid lines in FIG. 19, and the oscillatory, pivotal cycle repeats. The primary blade 736 has a longer moment arm than auxiliary blade 740 and, thus, the effect of the primary blade may overcome any opposing effect of the auxiliary blade in the solid line position of FIG. 19. Further, in this position the auxiliary blade is positioned toward one side of the jet stream and its surface 742 has relatively little inclination to the jet stream axis.

There have been described a number of different devices and methods for effecting the pulsation of a discharged air/water mixture employing various types of mechanisms for momentary disturbance of an increased velocity stream having improved efficiency and simplicity and readily adaptable for automatic operation.

The foregoing detailed description is to be clearly understood as given by way of illustration and example only, the spirit and scope of this invention being limited solely by the appended claims.

What is claimed is:

1. In a venturi type mixer wherein an increased velocity stream of liquid in a liquid conduit is projected through a jet nozzle into a mixing chamber and pulls gas from a gas conduit into the mixing chamber venturi b6 action for mixture with the liquid and discharge from the chamber, the improvement comprising apparatus for pulsing the discharge of liquid and gas from said chamber and decreasing the inflow of gas into the mixing chamber, said apparatus comprising means in said mixing chamber downstream of said jet nozzle for intermittently disturbing the flow of liquid in said chamber so as to intermittently disturb the venturi action and the pulling of gas into the chamber, whereby the discharge of liquid and gas from the chamber pulsates.

2. The apparatus of claim 1 wherein said means in said chamber comprises a spoiler, and including means for repetitively shifting said stream in said chamber so as to cause the stream to repetitively impinge upon said spoiler.

3. The apparatus of claim 2 wherein said means for shifting said stream comprises a rotor having a jet nozzle for projecting said increased velocity stream along a path that rotates in said chamber, said spoiler comprising a flow disturbing member fixedly mounted within said chamber and having a portion positioned to intercept said stream at a point along said path.

4. The apparatus of claim 1 wherein said means in said chamber comprises a blade journaled in said chamber on an axis offset from the stream.

5. The apparatus of claim 1 wherein said means in said chamber comprises a spoiler mounted for motion between a first position in which the spoiler intersects the path of the liquid stream within the mixing chamber and a second position in which the spoiler is displaced from such path, and means for cyclically moving the spoiler between said first and second positions.

6. The apparatus of claim 5 wherein said spoiler and said means for cyclically moving said spoiler comprise a blade inclined to the path of said stream and journaled upon an axis displaced from said stream.

7. The apparatus of claim 5 wherein said means for moving the spoiler comprises a liquid driven rotor and means responsive to said rotor for driving said spoiler, said increased velocity stream being offset from the center of said mixing chamber.

8. The apparatus of claim 7 wherein said rotor comprises a rotor body mounted for rotation within the mixing chamber, a plurality of blades carried by said body, said spoiler being mounted on said rotor body.

9. The apparatus of claim 5 wherein said spoiler is mounted for reciprocation between said first and second positions.

10. The apparatus of claim 9 wherein said spoiler includes first and second blades mounted for pivotal reciprocation to and from said positions.

11. The apparatus of claim 9 wherein said means for moving said spoiler between said first and second positions comprises a piston, means for driving said spoiler in response to motion of said piston, and means responsive to pressure within said chamber for reciprocating said piston.

12. The apparatus of claim 11 including an access aperture adjacent a part of the mixer at which liquid and gas is discharged, such aperture communicating with said piston and spoiler whereby said piston and spoiler may be removed from and inserted into operative position with respect to said chamber, and means for closing said access aperture.

13. The apparatus of claim 5 wherein said means for moving said spoiler between said first and second positions comprises a gas input fitting connected with said chamber, a sleeve fixed to said fitting and having a plurality of gas admitting apertures, a piston reciprocally mounted in said sleeve to block and unblock said sleeve apertures, said sleeve being spaced from the interior surface of said fitting to provide a gas passage in communication with said chamber, and means for urging said piston in one direction, whereby decreased pressure within said chamber is communicated to said piston to move said piston in one direction and the movement of said spoiler to disturb the flow of liquid in said chamber raises the pressure in said chamber to permit the piston to be driven in the other direction, and means for connecting said piston and spoiler.

14. The apparatus of claim 13 wherein said means for connecting said piston and spoiler comprises a rod pivotally connected to said piston, said spoiler comprising an end of said rod remote from said piston.

15. The apparatus of claim 13 wherein said means for connecting said piston and spoiler comprises a rod fixedly connected at one end thereof to said piston, said spoiler comprising the other end of said rod.

16. The mixer of claim 1 wherein said means for intermittently disturbing comprises a blade pivoted to said nozzle for reciprocation to and from said stream of liquid.

17. The mixer of claim 1 wherein said means for disturbing comprises a spoiler, and means for mounting one of said spoiler and nozzle for rotation relative to the other.

18. The mixer of claim 1 wherein said means for intermittently disturbing comprises a spoiler mounted for motion within said chamber between a first position intercepting said stream of liquid and a second position retracted from said stream.

19. For use with a swimming pool, therapy pool, spa or the like having a pool wall confining a body of water, a pulsating air/water venturi type mixer for projecting an air/water mixture through the pool wall into the water below the surface thereof, said mixer comprising a mixer body defining a mixing chamber having air and water input ports and a mixture outlet, a jet nozzle in said mixing chamber positioned to project an increased velocity stream of water from said water input port along a path in said chamber toward said mixture outlet, said increased velocity stream causing a venturi action that pulls air from an air conduit connected to said air input port into said chamber for mixing with water and discharge from the chamber, a flow disturbing member for intermittently disturbing the flow of water in said mixing chamber so as to intermittently disturb the venturi action and the pulling of air into said chamber, said flow disturbing member having at least a portion thereof in said mixing chamber downstream of said jet nozzle, and means for repetitively changing the relative positions of said flow disturbing member portion and said path so as to cause said member to repetitively intercept at least part of said stream and repetitively disturb said venturi action and the pulling of air into said chamber, whereby the air/water mixture discharged by the mixer pulsates.

20. The mixer of claim 19 wherein said means for repetitively changing relative positions comprises means for cyclically shifting the path of said stream in said chamber.

21. The mixer of claim 20 wherein said means for shifting comprises a rotor, said jet nozzle being carried by said rotor, said flow disturbing member being fixedly mounted in said chamber.

22. The mixer of claim 19 wherein said means for changing relative positions comprises a rotor journaled to said nozzle and having a blade movable to and from said path, said blade comprising said flow disturbing member.

23. The mixer of claim 19 wherein said flow disturbing member comprises a spoiler fixed in said chamber and wherein said means for changing relative positions comprises a rotor mounted in the path of and upstream from said mixing chamber, said jet nozzle being mounted on said rotor for rotation therewith to project said increased velocity stream of water along a rotating path.

24. The mixer of claim 19 wherein said means for repetitively changing relative positions comprises a rotor mounted in the path of and downstream from water projected from said jet nozzle, said flow disturbing member comprising a spoiler element mounted upon an upstream portion of said rotor, said spoiler being positioned to move with said rotor through a circular path to repetitively intercept the path of said stream of water in said chamber at a point thereof adjacent said jet nozzle, said nozzle being radially offset from the center of said chamber.

25. The mixer of claim 19 wherein said flow disturbing member comprises a spoiler connected to reciprocate into and out of the path of said stream of water in said chamber.

26. The mixer of claim 19 wherein said means for repetitively changing relative positions comprises a piston, means for reciprocating said piston, said flow disturbing member being connected to said piston.

27. The mixer of claim 26 wherein said means for reciprocating said piston includes means at least partially responsive to pressure within said mixing chamber.

28. The mixer of claim 19 wherein said flow disturbing member comprises rotary means accessible through said outlet.

29. In a venturi type mixer wherein an increased velocity stream of liquid in a liquid conduit is projected from a jet nozzle into a mixing chamber and causes a venturi action that pulls gas from a gas conduit into the chamber for mixture with the liquid and discharge from the chamber, the improvement comprising apparatus for pulsing the discharge of liquid and gas from said chamber and decreasing the inflow of gas into the chamber, said apparatus comprising a rotor journaled in said mixing chamber and positioned downstream of said jet nozzle, said rotor having means for driving the rotor about a rotor axis and means for intermittently disturbing the flow of liquid in said chamber so as to intermittently disturb the venturi action and intermittently decrease the amount of air pulled into the chamber, whereby discharge of liquid and gas from the chamber pulsates.

30. The mixer of claim 29 wherein said rotor axis is offset from the axis of said jet nozzle.

31. The mixer of claim 30 wherein said rotor is journaled upon said jet nozzle.

32. The mixer of claim 31 wherein said rotor axis is skewed relative to said jet nozzle axis.

33. The mixer of claim 30 wherein said means for disturbing flow comprises at least one rotor blade mounted for rotation between a first position in which said blade interrupts said stream and a second position in which said blade is displaced from said stream.

34. The mixer of claim 33 wherein said means for driving the rotor includes said rotor blade.

35. A pulsating air-water mixer comprising a mixer body having an air-water mixing chamber therein and a mixture outlet communicating with said mixing chamber, nozzle means for introducing a stream of water into said mixing chamber along a nozzle axis, means for admitting air into said mixing chamber, and a rotor journaled in said mixing chamber upon a rotor axis offset from said nozzle axis for intermittently disturbing said stream of water, said rotor including first and second blades extending in different directions radially of said rotor axis, adjacent edges of said blades being mutually spaced by an amount sufficient to enable both of said blades to clear said stream of water in one position of rotation of said rotor, said first blade extending entirely across said stream of water in a second position of rotation of said rotor, said second blade being shorter than said first blade and said rotor axis being skewed forwardly and outwardly of said nozzle axis.

36. For use with an air/water mixer of a swimming pool, therapy pool, spa or the like, the mixer having an air/water mixing chamber therein, a mixture output communicating with the mixing chamber, and means for admitting air into said chamber, improved pulsating nozzle apparatus comprising a water jet nozzle adapted to be mounted to said mixer body with an outlet end within said mixing chamber for projecting a stream of increased velocity water into and across said mixing chamber along a nozzle axis into the mixer body outlet, and a rotor mounted upon said nozzle end for rotation about an axis directed substantially along and spaced from the axis of said nozzle, said rotor including means responsive to water projected from the nozzle for rotating the rotor and including spoiler means for intermittently disturbing a stream of water projected from the nozzle as the rotor rotates so as to intermittently decrease flow of air into said chamber and effect pulsation of the air/-water mixture discharged from the mixer body outlet.

* * * * *